US007133762B2

(12) United States Patent
Sekita et al.

(10) Patent No.: US 7,133,762 B2
(45) Date of Patent: Nov. 7, 2006

(54) CONTROL DEVICE FOR ENGINE DRIVEN VEHICLE INCORPORATING GENERATOR

(75) Inventors: Tomoaki Sekita, Numazu (JP); Kazuyoshi Kishibata, Numazu (JP); Yuichi Kitagawa, Numazu (JP); Hiroyasu Sato, Numazu (JP)

(73) Assignee: Kokusan Denki Co., Ltd., Shizuoka-ken (JP)

( * ) Notice: Subject to any disclaimer, the term of this patent is extended or adjusted under 35 U.S.C. 154(b) by 0 days.

(21) Appl. No.: 11/257,729

(22) Filed: Oct. 25, 2005

(65) Prior Publication Data

US 2006/0089233 A1 Apr. 27, 2006

(30) Foreign Application Priority Data

Oct. 25, 2004 (JP) ..... 2004-309490

(51) Int. Cl.
*F02D 41/22* (2006.01)
*F02P 11/00* (2006.01)

(52) U.S. Cl. ..... 701/107; 701/110; 123/333; 123/335

(58) Field of Classification Search ..... 701/107, 701/105, 110, 112, 114, 103; 123/320, 332–335, 123/339.23, 399, 406.13, 406.18, 406.25, 123/406.35, 406.45, 406.58, 196 S, 198 D; 477/84, 91

See application file for complete search history.

(56) References Cited

U.S. PATENT DOCUMENTS 6,845,315 B1 * 1/2005 Hashimoto et al. ..... 701/114
6,971,969 B1 * 12/2005 Kitagawa et al. ..... 477/3
6,973,383 B1 * 12/2005 Mitsutani et al. ..... 701/112

FOREIGN PATENT DOCUMENTS

JP 2004-092634 3/2004

* cited by examiner

*Primary Examiner*—Andrew M. Dolinar
*Assistant Examiner*—Johnny H. Hoang
(74) *Attorney, Agent, or Firm*—Pearne & Gordon LLP

(57) ABSTRACT

An engine driven vehicle having a function of supplying power to an external load from a generator driven by an engine that is operated in a power generation mode while the vehicle is stopped, including: throttle position determination means for determining whether a throttle valve is placed closer to an acceleration side than a normal position in the power generation mode while the engine is operated in the power generation mode; and safety engine control means for conducting a control to prevent the engine from being operated at a higher speed than a set speed limit when the determination means determines that the throttle valve is placed closer to the acceleration side than the normal position in the power generation mode.

18 Claims, 5 Drawing Sheets

CONTROL DEVICE FOR ENGINE DRIVEN VEHICLE INCORPORATING GENERATOR

TECHNICAL FIELD OF THE INVENTION

The present invention relates to a control device for an engine driven vehicle for controlling an engine of the vehicle that incorporates a generator driven by the engine for driving a vehicle, and can supply power from the generator to a load while the vehicle is stopped.

BACKGROUND OF THE INVENTION

Engine driven vehicles such as ATVs (All Terrain Vehicles, so-called buggies), tractors, or recreation vehicles that are engine driven vehicles intended mainly for driving on rough ground have been incorporating a generator driven by an engine for driving the vehicle to supply a commercial AC output of AC 100 V, AC 200 V (50 Hz or 60 Hz), or the like to a load while the vehicle is stopped, in order to allow electric tools or home appliances to be used outdoors. Such an engine driven vehicle is, for example, disclosed in Japanese Patent Laid-Open No. 2004-92634.

In such an engine driven vehicle, a gear position sensor that detects a gear position of a power transmission device is provided, and only when the gear position sensor detects that the gear position is in a position for cutting power transmission, control of a rotational speed in a power generation mode is performed, in order to prevent the vehicle from starting when the generator is operated.

As described above, if the control of the rotational speed in the power generation mode is performed only when the gear position sensor detects that the gear position is in the position for cutting power transmission, the vehicle can be prevented from starting during an operation in the power generation mode. In the engine driven vehicle thus comprised, however, if a driver inadvertently operates a throttle valve to an acceleration side during the operation in the power generation mode, the rotational speed of the engine increases to cause an excessive output of the generator, which may break a circuit connected to an output side of the generator or a load of the generator.

Further, even in the case where the control of the rotational speed in the power generation mode is performed only when the gear position sensor detects that the gear position is in the position for cutting power transmission, if the gear position sensor or a gearbox is broken, the power generation mode may be selected when false detection is made that the power transmission device is in a state for cutting power transmission though the power transmission device is actually in a state for transmitting power. In this case, if the power transmission device includes a centrifugal clutch, the rotational speed of the engine is increased when the power transmission device is in the state for transmitting power to drive wheels at a start of the operation of the generator, and thus the rotational speed of the engine may exceed a clutch-in speed of the centrifugal clutch to cause the vehicle to start.

In order to avoid such problems, it is preferable that an allowable rotational speed of the engine in the operation in the power generation mode is previously determined, and the rotational speed of the engine does not exceed the allowable rotational speed when the throttle valve is operated during the operation in the power generation mode.

SUMMARY OF THE INVENTION

Therefore, an object of the present invention is to provide a control device for an engine driven vehicle incorporating a generator that can prevent an engine from being operated at a higher speed than an allowable rotational speed in a power generation mode when a throttle valve is inadvertently operated during an operation in the power generation mode.

The present invention is applied to a control device for an engine driven vehicle including: a vehicle body having drive wheels; an engine incorporated in the vehicle body; a power transmission device provided between a crankshaft of the engine and the drive wheels; and a generator provided to be driven by the engine without via the power transmission device.

The present invention further includes: power generation time intake air amount control means for controlling an intake air amount of the engine so as to rotate the engine at a rotational speed suitable for supplying power from the generator to an external load when a power generation mode is selected while the engine driven vehicle is stopped; throttle position determination means for determining whether a throttle valve of the engine is placed closer to an acceleration side than a normal position in the power generation mode when the power generation mode is selected; and safety engine control means for conducting a control to prevent the engine from being operated at a higher rotational speed than a speed limit in the power generation mode when the throttle position determination means determines that the throttle valve is placed closer to the acceleration side than the normal position in the power generation mode.

The power generation time intake air amount control means may be comprised so that a valve (for example, an ISC valve) provided separately from the throttle valve is controlled to control the intake air amount of the engine, or the throttle valve is controlled to control the intake air amount of the engine. When the power generation time intake air amount control means is comprised so that the throttle valve is controlled to control the intake air amount of the engine, a mechanism for adjusting a fully closed position of the throttle valve (a mechanism for adjusting an opening degree when the throttle valve is fully closed) is preferably provided to control the fully closed position of the throttle valve, thereby controlling the intake air amount of the engine.

The normal position of the throttle valve in the power generation mode is the fully closed position both when the valve provided separately from the throttle valve is controlled to control the intake air amount of the engine and when the fully closed position of the throttle valve is controlled to control the intake air amount of the engine.

Comprised as described above, when the throttle valve of the engine is inadvertently operated closer to the acceleration side than the normal position in the power generation mode while the engine is operated in the power generation mode, the control is performed to prevent the engine from being operated at the higher rotational speed than the speed limit, which is a rotational speed set to a rotational speed or less of the engine when an output voltage of the generator reaches an allowable upper limit value. This prevents an excessive output of the generator caused by an increase in the rotational speed of the engine from breaking a circuit on an output side of the generator or a load of the generator while the engine is operated in the power generation mode.

The control to prevent the engine from being operated at the higher rotational speed than the speed limit may be a control to limit the rotational speed of the engine to the speed limit or less, or control to stop the engine.

Specifically, the safety engine control means used in the present invention may be means for conducting a control to limit the rotational speed of the engine to a rotational speed which is equal to or less than the speed limit in the power generation mode when the throttle position determination means determines that the throttle valve is placed closer to the acceleration side than the normal position in the power generation mode, and may be means for conducting a control to stop the engine when the throttle position determination means determines that the throttle valve is placed closer to the acceleration side than the normal position in the power generation mode.

The safety engine control means for conducting the control to limit the rotational speed of the engine to a rotational speed which is equal to or less than the speed limit when the throttle position determination means determines that the throttle valve is placed closer to the acceleration side than the normal position in the power generation mode is preferably comprised so as to stop at least either supply of fuel to the engine or an ignition operation of the engine when the rotational speed of the engine exceeds the speed limit to limit the rotational speed of the engine to a rotational speed which is equal to or less than the speed limit.

The safety engine control means for conducting a control to stop the engine when the throttle position determination means determines that the throttle valve is placed closer to the acceleration side than the normal position in the power generation mode is preferably comprised so as to stop at least either supply of fuel to the engine or an ignition operation of the engine to stop the engine.

The speed limit is set to the allowable upper limit value of the rotational speed of the engine in the power generation mode. In the preferable aspect of the present invention, the speed limit is set to the rotational speed or less of the engine when the output voltage of the generator reaches the allowable upper limit value.

Setting the speed limit as described above prevents the excessive output voltage of the generator, thereby preventing the circuit connected to the output side of the generator or the load of the generator from being broken by overvoltage, when the throttle valve is operated while the engine is controlled in the power generation mode.

When a power transmission device including a centrifugal clutch is used in the engine driven vehicle to which the present invention is applied, if a gear position of the power transmission device is in a position other than a neutral position and a parking position, and the generator is operated in a state for transmitting power via the power transmission device, the centrifugal clutch may be engaged to cause the vehicle to start when the rotational speed of the engine reaches a clutch-in speed or more. In order to prevent such a circumstance, when the power transmission device is used including the centrifugal clutch that is closed when the rotational speed of the engine reaches a predetermined clutch-in speed or more, the speed limit is set to the rotational speed or less of the engine when the output voltage of the generator reaches the allowable upper limit value, and less than the clutch-in speed of the centrifugal clutch.

If the speed limit is set as described above, when the throttle valve is inadvertently operated closer to the acceleration side than the normal position in the power generation mode while the engine is operated in the power generation mode, the excessive output voltage of the generator can be prevented, and the operation of the engine at the rotational speed equal to or higher than the clutch-in speed can be also prevented while the engine is operated in the power generation mode to prevent the vehicle from starting.

When the speed limit is set to less than the clutch-in speed of the centrifugal clutch as described above, the generator is preferably comprised so as to generate a rated output when the rotational speed of the engine is between an idle rotational speed and the clutch-in speed.

The throttle position determination means may be comprised so as to determine whether the throttle valve is placed closer to the acceleration side than the normal position in the power generation mode from an output of a position sensor that detects a position of the throttle valve. The position sensor may be of any type as long as the sensor generates an electrical signal including information on the position of the throttle valve.

A position detection switch (for example, a limit switch) may be provided that is in different states between when the throttle valve is in the normal position in the power generation mode and when the throttle valve is placed closer to the acceleration side than the normal position in the power generation mode, and the throttle position determination means may be comprised so as to determine whether the throttle valve is placed closer to the acceleration side than the normal position in the power generation mode from the state of the position detection switch.

As described above, according to the present invention, when the throttle valve is inadvertently operated closer to the acceleration side than the normal position in the power generation mode while the engine is operated in the power generation mode, the control is performed to prevent the engine from being operated at the higher rotational speed than the speed limit in the power generation mode. This prevents the excessive output of the generator caused by the increase in the rotational speed of the engine from breaking the circuit on the output side of the generator or the load of the generator while the engine is operated in the power generation mode.

If the power transmission device includes the centrifugal clutch and the speed limit is set to less than the clutch-in speed of the centrifugal clutch, when the throttle valve is inadvertently operated closer to the acceleration side than the normal position in the power generation mode while the engine is operated in the generation mode, the engine is prevented from being operated at the rotational speed equal to or higher than the clutch-in speed to prevent the vehicle from starting while the engine is operated in the power generation mode.

BRIEF DESCRIPTION OF THE DRAWINGS

The above and other objects and features of the invention will be apparent from the detailed description of the preferred embodiments of the invention, which are described and illustrated with reference to the accompanying drawings, in which.

DETAILED DESCRIPTION OF THE PREFERRED EMBODIMENTS

Now, preferred embodiments of the present invention will be described with reference to the drawings.

Figure 1:
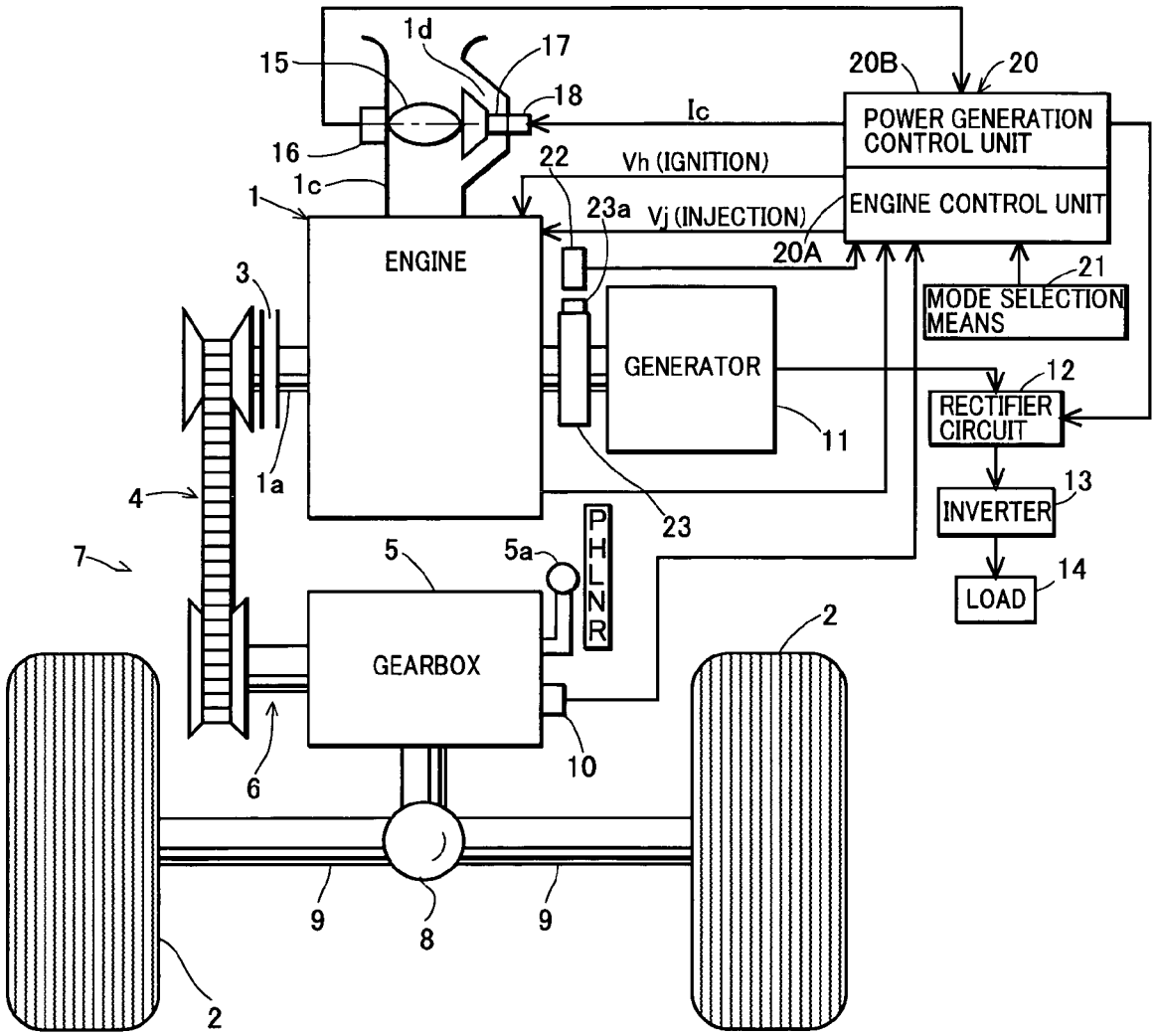
FIG. 1 is a schematic diagram of a construction example of an engine driven vehicle to which the present invention is applied.

FIG. 1 is a schematic diagram of a construction example of essential portions of an engine driven vehicle to which the present invention is applied.

The engine driven vehicle to which the present invention is applied incorporates a power supply unit that uses a generator mounted to an engine for driving the vehicle as a power supply to output AC power at commercial frequencies. Such an engine driven vehicle includes an ATV (a buggy), a tractor, a recreational vehicle, or the like.

In FIG. 1, 1 denotes an engine (an internal combustion engine) incorporated in an unshown vehicle body having drive wheels 2. The engine 1 may be a two cycle engine or a four cycle engine. An end of a crankshaft 1*a* of the engine 1 is connected to an axle 9 to which the drive wheels 2 are mounted, via a power transmission device 7 including an centrifugal clutch 3 that is engaged when a rotational speed of the engine reaches a predetermined clutch-in speed (generally, 2000 r/min to 3000 r/min) or more, and a CVT (continuously variable transmission) 6 having a belt transmission mechanism 4 and a gearbox 5, and a gear mechanism 8.

A gear position selection lever 5*a* is mounted to the gearbox 5, and the lever is operated to switch a gear position to a parking position P, a high position H, a low position L, a neutral position N, or a reverse (backing up) position R. A gear position sensor 10 that detects the gear position is mounted to the gearbox 5.

Among the gear positions, the neutral position N and the parking position P are positions for cutting power transmission from the engine to the drive wheels, and the high position H, the low position L, and the reverse (backing up) position R are positions for transmitting power from the engine to the drive wheels.

A rotor of a generator 11 is mounted to the other end of the crankshaft 1*a* of the engine 1. A stator of the generator 11 is secured to a mounting portion provided on a case or a cover of the engine.

The shown generator 11 is a magnetic AC generator having a magnetic field produced by a permanent magnet on the rotor side and an armature coil on the stator side, and an AC output of the generator is converted into a DC output by a rectifier circuit 12 and then input to an inverter 13.

The shown inverter 13 is of known type including a bridge-type switch circuit with sides of a bridge being comprised of switch elements. The inverter 13 is controlled by inverter control means provided in a control device described below, and converts the DC output from the rectifier circuit 12 into an AC output at a predetermined frequency (generally, commercial frequencies).

In this example, the power supply unit that generates an AC voltage at commercial frequencies is comprised of the generator 11, the rectifier circuit 12, the inverter 13, and the inverter control means for controlling the inverter 13, and the AC output of the inverter 13 is supplied to an external load 14.

1*c* denotes an intake pipe of the engine to which a throttle valve 15 is mounted. An input shaft of a position sensor 16 that generates a position detection signal increasing in magnitude with movement of the throttle valve toward the acceleration side (a position detection signal having magnitude proportional to an opening degree of the throttle valve) is connected to an operation shaft of the throttle valve 15. As the position sensor 16, for example, a potentiometer having a rotating shaft connected to the operation shaft of the throttle valve may be used.

In the intake pipe 1*c*, a bypass passage 1*d* that bypasses the throttle valve 15 is provided, and an ISC valve 17 is provided that adjusts the amount of air flowing through the bypass passage when an idle rotational speed of the engine is controlled. An actuator 18 comprised of a solenoid is mounted to the ISC valve 17, and PWM control of a drive current Ic supplied to the actuator 18 allows an opening degree of the ISC valve 17 to be adjusted.

An unshown injector (an electromagnetic fuel injection valve) is mounted to the intake pipe 1*c* of the engine 1, and an ignition plug is mounted to a cylinder head of the engine 1.

20 denotes a control device including a microprocessor, an ignition circuit, an injector drive circuit, or the like, and 21 denotes mode selection means comprised of a manually operated switch. The mode selection means 21 provides to the control device 20 a mode selection instruction to select an operation mode of the engine between a vehicle driving mode and a power generation mode according to a state of the switch.

A signal generator 22 that generates a pulse signal when a crank angle position of the engine 1 matches a particular position is mounted to the engine 1. The shown signal generator 22 is of known type that generates a pulse signal when a leading edge and a trailing edge in a rotational direction of a reluctor (an inductor) 23*a* provided on an outer periphery of a rotor 23 directly connected to the other end of the crankshaft 1*a* of the engine are detected. An output of the signal generator 22 is input to the control device 20 together with an output of the gear position sensor 10 and an output of the position sensor 16 that detects a position of the throttle valve. The reluctor 23*a* may be a protrusion or a recess.

Various sensors, though not shown, that detect control conditions (engine temperature, atmospheric pressure, or the like) used for controlling an ignition timing and a fuel injection amount of the engine are provided, and outputs of these sensors are input to the control device 20.

The control device 20 comprises an engine control unit (ECU) 20A that causes a microprocessor to execute a predetermined program to perform control required for operating the engine (control of the ignition timing or the fuel injection amount), and a power generation control unit 20B that controls to generate an output required for driving the external load 14 from the generator when the mode selection means 21 selects the power generation mode.

Figure 2:
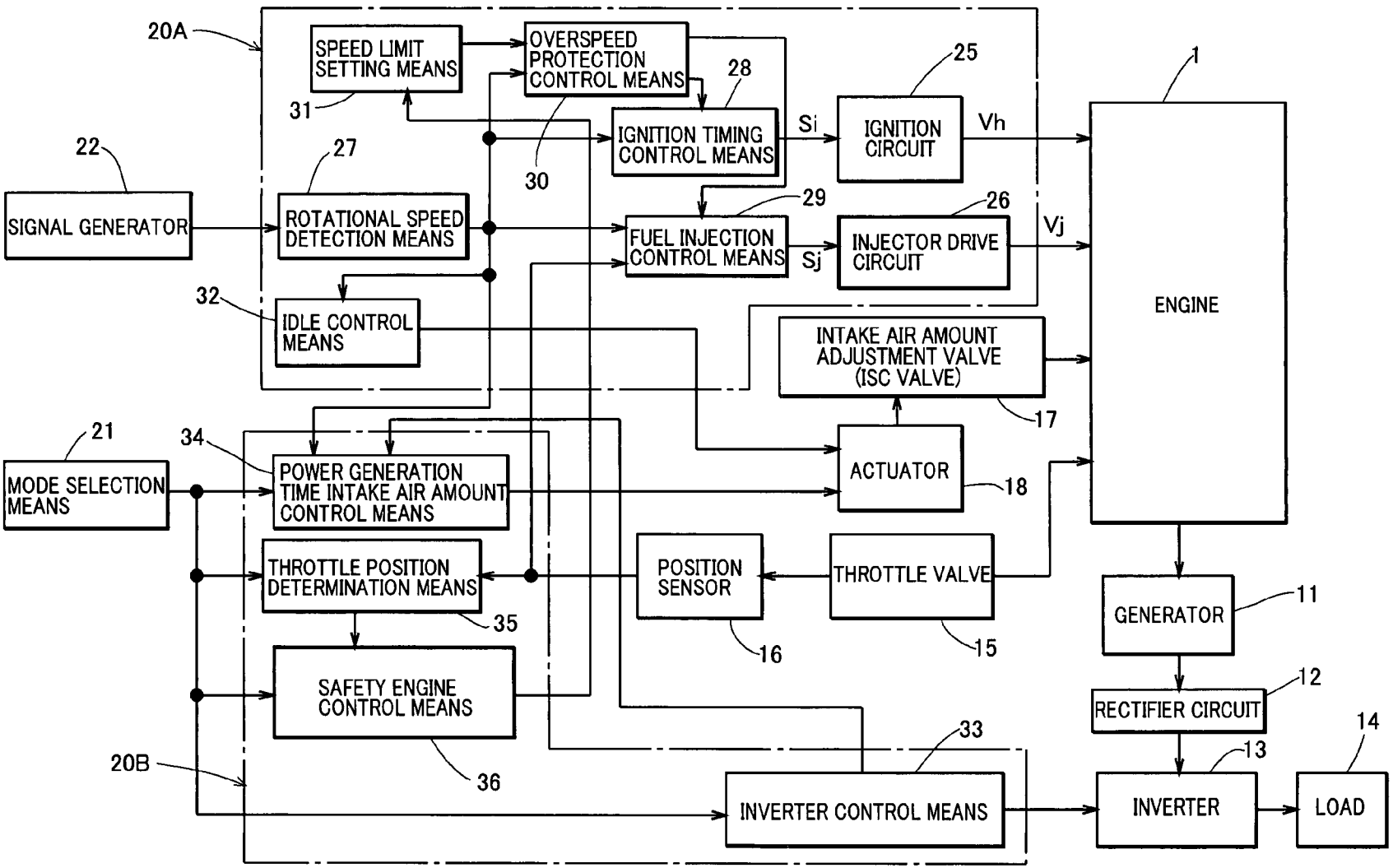
FIG. 2 is a block diagram of a construction of a control device used in the engine driven vehicle in FIG. 1.

FIG. 2 shows a construction of the control device 20 used in the engine driven vehicle in FIG. 1. In the example in FIG. 2, the engine control unit 20A is comprised of an ignition circuit 25 that ignites the engine, an injector drive circuit 26, rotational speed detection means 27, ignition timing control means 28, fuel injection control means 29, overspeed protection control means 30, speed limit setting means 31, and idle control means 32.

Describing these parts, the ignition circuit 25 is a circuit that generates a high voltage Vh for ignition when the ignition timing control means 28 provides an ignition signal Si, and comprises an ignition coil, and a primary current control circuit that causes an abrupt change in a primary current of the ignition coil for inducing a high voltage in a secondary side of the ignition coil when the ignition signal Si is provided from an ignition timing control circuit described below. An ignition high voltage Vh generated by the ignition circuit 25 is applied to an ignition plug mounted to a cylinder head of the engine 1. When the high voltage for ignition is supplied to the ignition plug, spark discharge occurs in a discharge gap of the ignition plug to ignite the engine.

The injector drive circuit 26 is a circuit for supplying a drive current to a solenoid of the injector (the electromagnetic fuel injection valve) mounted to the intake pipe of the engine. The injector drive circuit 26 applies a drive voltage Vj to the injector while the fuel injection control means 29 provides an injection instruction signal to pass the drive current through the solenoid of the injector. The injector opens a valve thereof to inject fuel while the injector drive circuit 26 supplies the drive current. The fuel is supplied to the injector from an unshown fuel pump at a predetermined pressure. The pressure of the fuel supplied to the injector is maintained constant by a pressure regulator, and thus the fuel injection amount is controlled by a time for the injector to inject the fuel (a fuel injection time).

The rotational speed detection means 27 is means for detecting the rotational speed of the engine, and arithmetically operates the rotational speed of the engine from a generation interval (a time required for the engine to rotate through a certain angle) of pulses output by the signal generator 22.

The ignition timing control means 28 is means for controlling the ignition timing of the engine, and comprises ignition timing arithmetical operation means for arithmetically operating the ignition timing of the engine under various control conditions such as the rotational speed of the engine detected by the rotational speed detection means 27, and ignition signal generation means for generating the ignition signal Si when the crank angle position of the engine matches a crank angle position corresponding to the arithmetically operated ignition timing. The ignition signal Si generated by the ignition timing control means 28 is provided to the ignition circuit 25.

The fuel injection control means 29 arithmetically operates the fuel injection time according to various control conditions such as the rotational speed of the engine, the opening degree of the throttle valve, atmospheric pressure, and engine temperature, and provides to the injector drive circuit 26 an injection instruction signal having a rectangular waveform with a width corresponding to a time obtained by adding an ineffective injection time of the injector to the arithmetically operated fuel injection time.

The overspeed protection control means 30 is means for controlling the ignition operation and the fuel injection operation of the engine so that the rotational speed of the engine does not exceed the speed limit. The overspeed protection control means stops an output of an injection instruction signal Sj from the fuel injection control means 29 to stop the fuel injection operation when the rotational speed of the engine detected by the rotational speed detection means 27 exceeds the speed limit, and stops the output of the ignition signal Si from the ignition timing control means 28 to stop the ignition operation of the engine, thereby reducing the rotational speed of the engine to a rotational speed which is equal to or less than the speed limit.

The overspeed protection control means 30 also restores the fuel injection operation and the ignition operation when the rotational speed of the engine reaches a set value or less that is set to a slightly lower value than the speed limit.

The speed limit setting means 31 is means for providing the speed limit when the overspeed protection control means 30 controls to limit the rotational speed of the engine. The speed limit setting means provides an allowable maximum rotational speed of the engine in normal driving of the vehicle to the overspeed protection control means 30 as a vehicle driving mode speed limit when the vehicle driving mode is selected, and switches the speed limit to a power generation mode speed limit set to a lower value than the clutch-in speed of the centrifugal clutch when a speed limit switching instruction is provided from safety engine control means described below.

The idle control means 32 controls a duty ratio of the drive current supplied to the actuator 18 to control the opening degree of the ISC valve 17 so as to maintain an idle rotational speed detected by the rotational speed detection means 27 at a set value during idling of the engine.

In the example in FIG. 2, inverter control means 33, power generation time intake air amount control means 34, throttle position determination means 35, and safety engine control means 36 are provided, and the power generation control unit 20B is comprised of these means.

The inverter control means 33 includes means for controlling on/off the switch elements that comprise the inverter 13 so as to output the AC voltage at commercial frequencies from the inverter 13 when the mode selection means 21 selects the power generation mode, and target rotational speed arithmetical operation means (not shown) for arithmetically operating a rotational speed of the engine required for matching the output voltage of the inverter 13 with a target value as a target rotational speed, based on a deviation between the target value (a rated value) of the output voltage of the inverter 13 and an output voltage of the rectifier circuit 12 that rectifies the output of the generator 11, and the target rotational speed arithmetically operated by the target rotational speed arithmetical operation means is provided to the power generation time intake air amount control means 34.

The power generation time intake air amount control means 34 is means for controlling the intake air amount of the engine so as to rotate the engine 1 at a rotational speed suitable for supplying power from the generator 11 to the external load 14 when the power generation mode is selected. The power generation time intake air amount control means 34 controls the actuator 18 to adjust the intake air amount flowing through the bypass passage 5*d* so as to control to match the rotational speed of the engine with the target rotational speed when a power generation mode shifting condition is satisfied such that the mode selection means 21 selects the power generation mode, the vehicle is stopped, and the gear position sensor 10 detects that the gear position of the gearbox 5 is not in a position for transmitting power. When the engine is controlled in the power generation mode, the position of the throttle valve 15 is held in the fully closed position.

In the embodiment, the generator 11 is comprised so as to generate a rated output when the engine rotates at a certain rotational speed between the idle rotational speed and the clutch-in speed. Thus, the generator is comprised so as to generate the rated output when the engine rotates at the certain rotational speed between the idle rotational speed and the clutch-in speed (a rotational speed at which the centrifugal clutch 3 is engaged), and thus the power generation time intake air amount control means 34 controls to rotate the engine at the speed between the idle rotational speed and the clutch-in speed in the power generation mode, thereby preventing the rotational speed of the engine from reaching the clutch-in speed in the power generation mode as long as the throttle valve is in the fully closed position.

This prevents the centrifugal clutch from being engaged at the time of power generation to cause the vehicle to start.

In order to generate the rated output from the generator at the rotational speed of the engine between the idle rotational speed and the clutch-in speed, for example, a larger number of windings of the armature of the generator or a stronger magnetic filed may be provided as compared with a conventional example.

The clutch-in speed of the centrifugal clutch may be increased to allow the rated output to be generated from the generator at the speed between the idle rotational speed and the clutch-in speed. Specifically, when the clutch-in speed of the centrifugal clutch conventionally used is too low for generating the rated output from the generator, the clutch-in speed may be changed to a higher value than the rotational speed required for generating the rated output from the generator.

An acceleration mechanism comprised of a gear mechanism or the like may be provided between the crankshaft of the engine and the rotor of the generator 11, and the rotor of the generator may be rotated at a higher speed than the rotational speed of the crankshaft. Thus, a generator equivalent to a conventional generator that generates a rated output at a higher speed than the clutch-in speed may be used to generate the rated output from the generator at the rotational speed of the engine between the idle rotational speed and the clutch-in speed.

As described above, the generator is comprised so as to generate the rated output when the engine rotates at the certain rotational speed between the idle rotational speed and the clutch-in speed, thereby preventing the rotational speed of the engine from reaching the clutch-in speed in the power generation mode as long as the throttle valve is in the normal position (the fully closed position) in the power generation mode.

In the generator comprised as described above, however, if a driver inadvertently operates the throttle valve 15 to the acceleration side while the engine is operated in the power generation mode, the intake air amount of the engine increases, and thus the rotational speed of the engine increases and sometimes exceeds the clutch-in speed.

The shift to the power generation mode is allowed only when the gear position of the gearbox 5 is in the position for cutting power transmission, and thus if the gear position sensor 10 and the gearbox 5 are normal, the mode will not be shifted to the power generation mode when the power transmission device is in the state for transmitting power. However, if the gear position sensor 10 or the gearbox 5 is broken, false detection is made that the gear position of the gearbox 5 is not in the position for transmitting power though the gear position is actually in the position for transmitting power to sometimes allow the shift to the power generation mode. If the mode is shifted to the power generation mode in this state, and the driver inadvertently operates the throttle valve to the acceleration side while the engine is operated in the power generation mode, the rotation of the engine 1 may be transmitted to the drive wheels 2 to cause the vehicle to start when the rotational speed of the engine exceeds the clutch-in speed.

In the embodiment, in order to prevent such a circumstance, there are provided the throttle position determination means 35 for determining whether the throttle valve of the engine is placed closer to the acceleration side than the normal position in the power generation mode as required when the power generation mode is selected, and the safety engine control means 36 for conducting a control to prevent the engine 1 from being operated at the higher speed than the speed limit in the power generation mode when the throttle position determination means 35 determines that the throttle valve 15 is placed closer to the acceleration side than the normal position in the power generation mode. In the embodiment, the speed limit in the power generation mode is set to less than the clutch-in speed of the centrifugal clutch and equal to or less than the rotational speed of the engine when the output voltage of the generator reaches the allowable upper limit value.

Specifically, the safety engine control means 36 used in the embodiment is comprised so as to conduct a control to limit the rotational speed of the engine to a rotational speed which is equal to or less than the power generation mode speed limit that is set to less than the clutch-in speed of the centrifugal clutch 3 and equal to or less than the rotational speed of the engine when the output voltage of the generator reaches the allowable upper limit value, when the throttle position determination means 35 determines that the throttle valve 15 is placed closer to the acceleration side than the normal position (the fully closed position in the embodiment) in the power generation mode.

The shown safety engine control means 36 is comprised so as to provide the switching instruction to the speed limit setting means 31 to switch the speed limit of the engine to the power generation mode speed limit that is set to less than the clutch-in speed of the centrifugal clutch when the throttle position determination means 35 determines that the throttle valve is placed closer to the acceleration side than the normal position in the power generation mode from the output of the position sensor 16 while the power generation mode is selected.

Thus, when the throttle valve is operated to the acceleration side while the power generation mode is selected, the overspeed protection control means 30 immediately stops the ignition operation and the fuel injection operation of the engine to reduce the rotational speed of the engine to a rotational speed which is equal to or less than the power generation mode speed limit that is lower than the clutch-in speed, thereby preventing the rotational speed of the engine from reaching the clutch-in speed. The overspeed protection control means 30 restores the ignition operation and the fuel injection operation of the engine when the rotational speed of the engine reaches the speed limit or less. At this time, if the throttle valve is still opened and the rotational speed of the engine is about to increase, the ignition operation and the fuel injection operation are stopped again to reduce the rotational speed of the engine. When the throttle valve is operated in the power generation mode, the above described operations are repeated to prevent the rotational speed of the engine from reaching the clutch-in speed of the centrifugal clutch 3, thereby preventing the vehicle from starting, and preventing the excessive rotational speed of the generator 11 from breaking the circuit connected to the output side of the generator or the load of the generator.

In the above description, the overspeed protection control means stops both the ignition operation of the engine and the supply of the fuel to the engine to reduce the rotational speed of the engine when the throttle position determination means 35 determines that the throttle valve is placed closer to the acceleration side than the normal position in the power generation mode. However, the overspeed protection control means 30 may be comprised so as to control to stop at least either the supply of the fuel to the engine or the ignition operation of the engine to reduce the rotational speed of the engine to the speed limit or less when the throttle position determination means 35 determines that the throttle valve is placed closer to the acceleration side than the normal position in the power generation mode.

In the above described example, the control is performed to limit the rotational speed of the engine to the set rotational speed or less that is set to less than the clutch-in speed when the throttle position determination means 35 determines that the throttle valve is placed closer to the acceleration side than the normal position in the power generation mode, but the engine may be stopped when the throttle position determination means 35 determines that the throttle valve 15 is placed closer to the acceleration side than the normal position in the power generation mode.

In order to stop the engine when the throttle position determination means 35 determines in the power generation mode that the throttle valve 15 is placed closer to the acceleration side than the normal position in the power generation mode, for example, an instruction to set the speed limit of the engine to zero (a stop instruction) may be provided to the speed limit setting means 31. When the stop instruction is provided from the safety engine control means 36 to the speed limit setting means 31, the overspeed protection control means 30 controls to stop at least either the supply of the fuel to the engine or the ignition operation of the engine to stop the engine.

As described above, instead of providing the stop instruction to the speed limit setting means 31 to set the speed limit of the engine to zero, the safety engine control means 36 may be comprised so as to directly provide an instruction to at least either the ignition timing control means 28 or the fuel injection control means 29 to stop an output of at least either the ignition signal Si or the injection instruction signal Sj.

As described above, the throttle position determination means is provided for determining whether the throttle valve 15 is placed closer to the acceleration side than the normal position in the power generation mode when the driving of the vehicle is stopped and the engine is operated in the power generation mode, and the rotational speed of the engine is controlled so as not to exceed the speed limit when the throttle position determination means determines in the power generation mode that the throttle valve 15 is placed closer to the acceleration side than the normal position in the power generation mode, thereby preventing the excessive output of the generator caused by the increase in the rotational speed of the engine from breaking the circuit connected to the output side of the generator or the load of the generator, and preventing the vehicle from starting while the engine is operated in the power generation mode.

In the control device in FIG. 2, when the power generation mode is not selected (when the vehicle driving mode is selected), the control of the intake air amount adjustment valve 17 by the power generation time intake air amount control means 34 is not performed, and the determination by the throttle position determination means 35 and the control by the safety engine control means 36 are not performed. In this case, the ignition timing and the fuel injection time of the engine are controlled according to a throttle operation by the driver to control the engine at the time of vehicle driving. When the power generation mode is not selected, the speed limit setting means 31 switches the speed limit of the engine to an allowable upper limit value of the rotational speed of the engine at the time of the vehicle driving to allow vehicle driving without any trouble.

Figure 4:
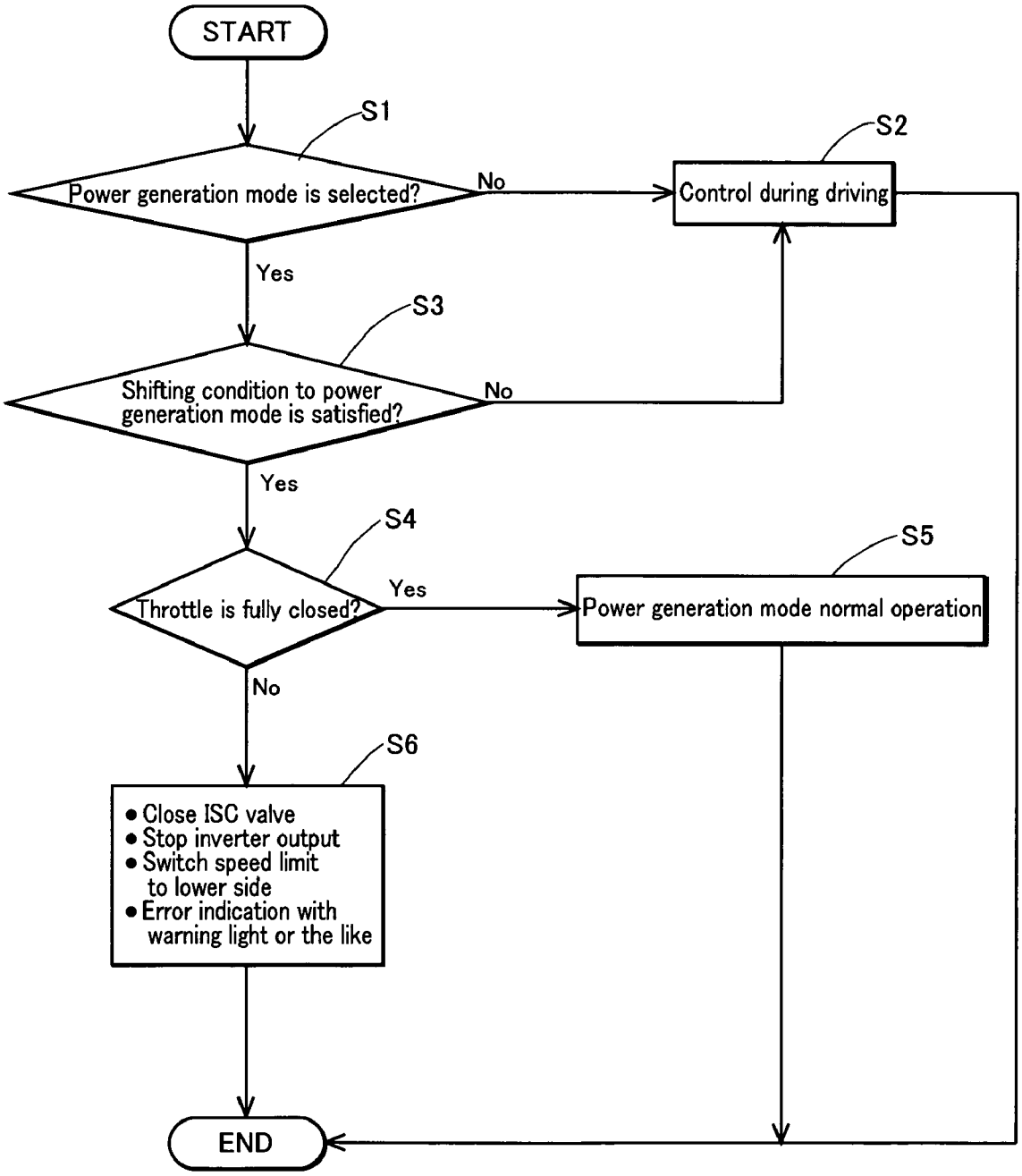
FIG. 4 is a flowchart of an algorithm of a task executed by a microprocessor in an embodiment in FIG. 2.

In order to construct various control means in the control device in FIG. 2, an example of an algorithm of a task executed by the microprocessor provided in the control device 20 is shown in FIG. 4. The task in FIG. 4 is executed at minimal time intervals during the operation of the engine, and according to the algorithm, when the task is started, it is determined first in Step S1 whether the power generation mode is selected. When it is determined that the power generation mode is not selected, the process moves to Step S2 to perform control in the vehicle driving.

When it is determined in Step S1 that the power generation mode is selected, the process moves to Step S3 to determine whether the condition for shifting to the power generation mode is satisfied. The condition for shifting to the power generation mode is that, for example, the vehicle is stopped, and the gear position sensor 10 detects the parking position. When it is determined in Step S3 that the condition for shifting to the power generation mode is not satisfied, the process moves to Step S2 to perform the control in the vehicle driving.

When it is determined in Step S3 that the condition for shifting to the power generation mode is satisfied, the process proceeds to Step S4, and it is determined whether the throttle valve is in the fully closed position (the normal position in the power generation mode) from the output of the position sensor 16. When it is determined that the throttle valve is in the fully closed position, the process moves to Step S5 to perform normal control operations in the power generation mode such as the control of the inverter 13 and the control of the intake air amount adjustment valve 17.

When it is determined in Step S4 that the throttle valve is placed closer to the acceleration side than the normal position in the power generation mode, the process moves to Step S6 to perform control to close the intake air amount adjustment valve (the ISC valve), control to stop the output of the inverter 13, control to switch the speed limit of the engine to the power generation mode speed limit that is set to less than the clutch-in speed of the centrifugal clutch and the rotational speed or less of the engine when the output voltage of the generator reaches the allowable upper limit value to limit the rotational speed of the engine to a rotational speed which is equal to or less than the power generation mode speed limit, and an error indication operation with a warning light or the like.

According to the algorithm in FIG. 4, the throttle position determination means 35 is comprised by Step S4, and the power generation time intake air amount control means 34 is comprised by Step S5. The safety engine control means 36 is comprised by Step S6.

In the embodiment, the throttle position determination means is comprised so as to determine whether the throttle valve is in the normal position (the fully closed position) in the power generation mode from the output of the position sensor 16 that detects the position of the throttle valve. However, a position detection switch (for example, a limit switch) may be provided that is in different states between when the throttle valve is in the normal position in the power generation mode and when the throttle valve is placed closer to the acceleration side than the normal position, and the throttle position determination means may be comprised so as to determine whether the throttle valve is placed closer to the acceleration side than the normal position in the power generation mode from the state of the position detection switch.

In the above described embodiment, the ISC valve that opens and closes the bypass passage that bypasses the throttle valve is used as the intake air amount adjustment means in the power generation mode, and the ISC valve is controlled to rotate the engine at the rotational speed suitable for generating power supplied from the generator to the load. However, the throttle valve 15 may be used as the intake air amount adjustment means in the power generation mode to control to match the rotational speed of the engine with the target rotational speed required for supplying required power from the generator to the load.

When the throttle valve 15 is used as the intake air amount adjustment means in the power generation mode, a throttle fully closed position adjustment mechanism that adjusts the fully closed position of the throttle valve 15 is used to control the fully closed position of the throttle valve 15 and control to match the rotational speed of the engine with the target rotational speed required for supplying required power from the generator to the load.

Figure 5:
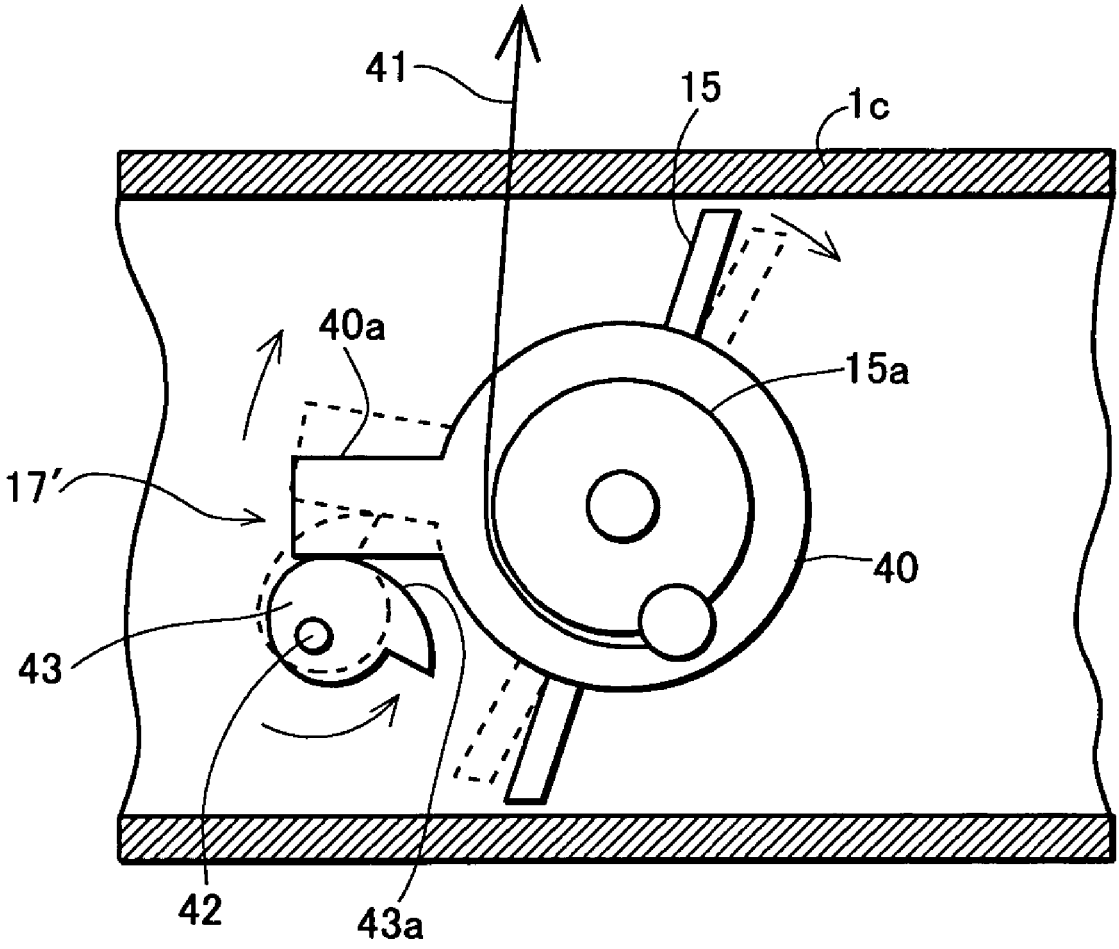
FIG. 5 is a sectional view of a construction example of a throttle fully closed position adjustment mechanism used in an embodiment in FIG. 3.

The throttle fully closed position adjustment mechanism is known as an idle up mechanism used as adjustment means of the intake air amount when the idle rotational speed of the engine is controlled, and a construction example thereof is shown in FIG. 5. In the example in FIG. 5, a throttle drum 40 is mounted to the operation shaft 15*a* that rotatably operates the throttle valve 15. The throttle drum 40 is provided so as to move together with the throttle valve 15, and always urged by an unshown spring in a direction of closing the throttle valve 15 (counterclockwise in the drawing). A throttle wire 41 is wound around the throttle drum 40, and the amount of unwound throttle wire 41 from the throttle drum is changed by a mechanism that cooperates with an unshown axle operation member (for example, an axle pedal) to adjust the opening degree of the throttle valve 15. A stopper protrusion 40*a* is provided on the throttle drum 40, and the stopper protrusion 40*a* abuts against a cam surface 43*a* of a stopper cam 43 rotatably supported by a rotating shaft 42. The stopper protrusion 40*a* and the stopper cam 43 are provided to determine the fully closed position of the throttle valve, and the position of the throttle valve when the stopper protrusion 40*a* abuts against the stopper cam 43 is the fully closed position of the throttle valve.

The stopper cam 43 is rotatably operated by an unshown actuator having a motor as a drive source, and the fully closed position of the throttle valve 15 is changed with the rotation of the stopper cam 43. In the example in FIG. 5, when the stopper cam 43 is in the shown position, the fully closed position of the throttle valve 15 is in a position for minimizing the opening degree at the time of full closing of the throttle valve, and when the stopper cam 43 is rotated counterclockwise from the shown position, the stopper protrusion 40*a* is pressed up by the stopper cam 43 to rotate the throttle drum 40 clockwise, and thus the fully closed position of the throttle valve 15 is changed to a side for increasing the opening degree at the time of full closing of the throttle valve as shown by the broken line in FIG. 5. In this example, a throttle fully closed position adjustment mechanism (an idle up mechanism) 17' is comprised of the stopper protrusion 40*a* and the stopper cam 43.

Figure 3:
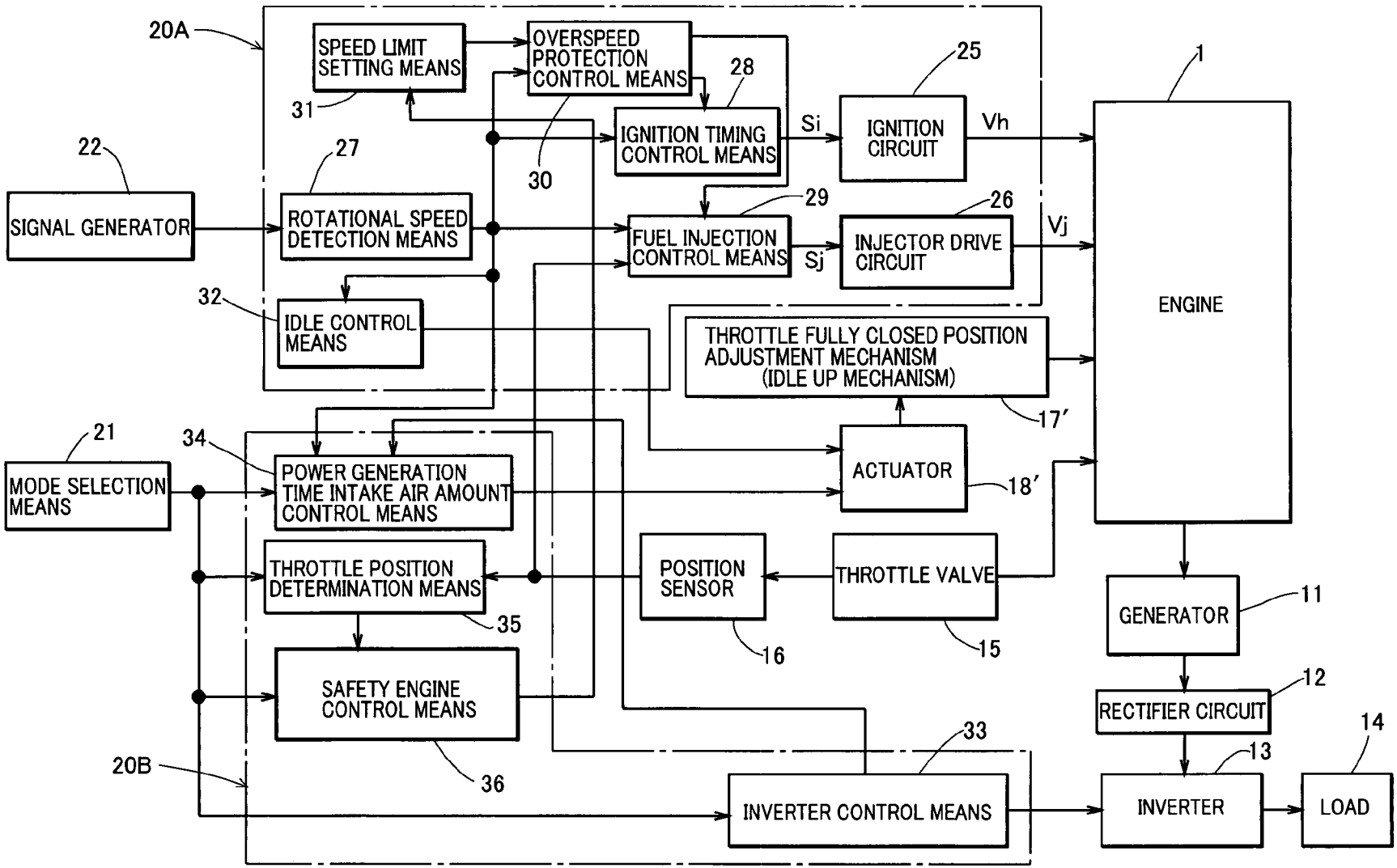
FIG. 3 is a block diagram of another construction of a control device used in the engine driven vehicle in FIG. 1.

FIG. 3 shows a construction example of a control device when an engine is controlled in a power generation mode by using the throttle fully closed position adjustment mechanism 17' shown in FIG. 5 to adjust an intake air amount of the engine. In the control device in FIG. 3, the throttle fully closed position adjustment mechanism 17' is used instead of the intake air amount adjustment valve (the ISC valve) used in the embodiment in FIG. 2. Idle control means 32 and power generation time intake air amount control means 34 control an actuator 18' that operates a stopper cam 43 of the throttle fully closed position adjustment mechanism to adjust a fully closed position of a throttle valve 15 and control the intake air amount.

If the control device is comprised as in FIG. 3, when the power generation mode is selected while an engine driven vehicle is stopped, the power generation time intake air amount control means 34 controls the actuator 18' that operates the stopper cam 43 so as to rotate the engine at a rotational speed suitable for supplying required power from a generator 11 to an external load 14 to control the fully closed position of the throttle valve 15, thereby controlling the intake air amount of the engine. Also in this case, the normal position of the throttle valve in the power generation mode is the fully closed position.

Throttle position determination means 35 in FIG. 3 may be comprised so as to determine whether the position of the throttle valve detected from an output of a position sensor 16 when the power generation mode is selected is placed closer to an acceleration side than a throttle valve position when the opening degree at the time of full closing of the throttle valve is maximum, and thus determine whether the throttle valve is placed closer to the acceleration side than the normal position in the power generation mode.

Safety engine control means 36 is comprised so as to control to reduce the rotational speed of the engine to a power generation mode speed limit or less that is set to less than a clutch-in speed or to stop the engine when the throttle position determination means 35 determines that the throttle valve 15 is placed closer to the acceleration side than the normal position (the fully closed position) in the power generation mode. Other points are comprised as in the embodiment in FIG. 2.

The generator 11 may be a dedicated generator for supplying power to the external load 14 while the vehicle is stopped, and may also serve as a generator for driving various electrical components incorporated in the vehicle or charging a battery while the vehicle is driving. When the generator 11 is the dedicated generator for driving the external load, a separate generator for driving the various electrical components is mounted to the engine.

In the example in FIG. 3, the throttle position determination means 35 is comprised so as to determine whether the throttle valve is placed closer to the acceleration side than the normal position in the power generation mode from the output of the position sensor 16. Also in this case, a position detection switch (for example, a limit switch) may be provided that is in different states between when the throttle valve is in the normal position in the power generation mode and when the throttle valve is placed closer to the acceleration side than the normal position, and the throttle position determination means 35 may be comprised so as to determine whether the throttle valve is placed closer to the acceleration side than the normal position in the power generation mode from the state of the position detection switch.

In each embodiment, the generator is comprised so as to generate the rated output when the rotational speed of the engine is between the idle rotational speed and the clutch-in speed, and the speed limit when the rotational speed of the engine is controlled by the safety engine control means is set to sufficiently lower than the clutch-in speed of the centrifugal clutch and the rotational speed or less of the engine when the output voltage of the generator reaches the allowable upper limit value. However, when sufficient reliability of the gear position sensor is ensured (when there is no risk of false detection that the power transmission device is in the position for cutting power transmission though the power transmission device is in the position for transmitting power), the speed limit may be set to the rotational speed or less of the engine when the output voltage of the generator reaches the allowable upper limit value without consideration of the clutch-in speed of the centrifugal clutch mainly for the purpose of preventing an excessive output voltage of the generator in the power generation mode. In this case, the generator may be comprised so as to generate the rated output at the rotational speed exceeding the clutch-in speed of the centrifugal clutch.

In the embodiment, the magneto generator is used as the generator 11, but an excitation synchronous generator may be used as the generator 11. When the excitation generator is used, power is directly supplied from the generator 11 to the external load 14 without an inverter. In this case, in the power generation mode, the intake air amount of the engine is controlled to maintain the rotational speed of the engine at a target rotational speed in the power generation mode, the target rotational speed being the rotational speed of the engine required for setting output frequencies of the generator 11 to commercial frequencies. Also, the magnetic field of the generator is controlled to supply a required output from the generator 11 to the load 14.

In the embodiment, the power transmission device provided between the crankshaft of the engine and the drive wheels of the vehicle includes the centrifugal clutch, but the present invention may be also applied to the case where a power transmission device including a normal clutch operated by a driver is used.

Although some preferred embodiments of the invention have been described and illustrated with reference to the accompanying drawings, it will be understood by those skilled in the art that they are by way of example, and that various changes and modifications may be made without departing from the spirit and scope of the invention, which is defined only to the appended claims.

What is claimed is:

1. A control device for an engine driven vehicle comprising:

a vehicle body having drive wheels;

an engine incorporated in said vehicle body;

a power transmission device provided between a crankshaft of said engine and said drive wheels; and a generator provided to be driven by said engine without via said power transmission device, wherein said control device further comprises:

power generation time intake air amount control means for controlling an intake air amount adjustment valve that adjusts the amount of air flowing through an air passage that bypasses a throttle valve of said engine so as to rotate said engine at a rotational speed suitable for supplying power from said generator to an external load when a power generation mode is selected while said engine driven vehicle is stopped;

throttle position determination means for determining whether said throttle valve is placed closer to an acceleration side than a normal position in the power generation mode when said power generation mode is selected; and safety engine control means for conducting a control to limit the rotational speed of said engine to a rotational speed which is equal to or less than a speed limit in the power generation mode when said throttle position determination means determines that said throttle valve is placed closer to the acceleration side than the normal position in the power generation mode, and said safety engine control means is comprised so as to stop at least either supply of fuel to said engine or an ignition operation of said engine to limit the rotational speed of said engine to said speed limit or less when the rotational speed of said engine exeeds said speed limit.

2. The control device for an engine driven vehicle according to claim 1, wherein said power transmission device comprises a centrifugal clutch that is closed when the engine rotates at a rotational speed which is equal to or more than a clutch-in speed, and said speed limit is set to a rotational speed which is equal to or less than a rotational speed of the engine when an output voltage of said generator reaches an allowable upper limit value, and which is less than said clutch-in speed.

3. The control device for an engine driven vehicle according to claim 2, further comprising a position sensor that detects the position of said throttle valve, wherein said throttle position determination means is comprised so as to determine whether said throttle valve is placed closer to the acceleration side than the normal position in the power generation mode from an output of said position sensor.

4. The control device for an engine driven vehicle according to claim 2, further comprising a position detection switch that is in different states between when said throttle valve is in the normal position in the power generation mode and when the throttle valve is placed closer to the acceleration side than the normal position in the power generation mode, wherein said throttle position determination means is comprised so as to determine whether said throttle valve is placed closer to the acceleration side than the normal position in the power generation mode from a state of said position detection switch.

5. The control device for an engine driven vehicle according to claim 1, further comprising a position sensor that detects the position of said throttle valve, wherein said throttle position determination means is comprised so as to determine whether said throttle valve is placed closer to the acceleration side than the normal position in the power generation mode from an output of said position sensor.

6. The control device for an engine driven vehicle according to claim 1, further comprising a position detection switch that is in different states between when said throttle valve is in the normal position in the power generation mode and when the throttle valve is placed closer to the acceleration side than the normal position in the power generation mode, wherein said throttle position determination means is comprised so as to determine whether said throttle valve is placed closer to the acceleration side than the normal position in the power generation mode from a state of said position detection switch. rotational speed of said engine exceeds said speed limit.

7. A control device for an engine driven vehicle comprising:

a vehicle body having drive wheels;

an engine incorporated in said vehicle body;

a power transmission device provided between a crankshaft of said engine and said drive wheels; and a generator provided to be driven by said engine without via said power transmission device, wherein said control device further comprises:

power generation time intake air amount control means for controlling a fully closed position of a throttle valve of said engine so as to rotate said engine at a rotational speed suitable for supplying power from said generator to an external load when a power generation mode is selected while said engine driven vehicle is stopped;

throttle position determination means for determining whether said throttle valve is placed closer to an acceleration side than a normal position in the power generation mode when said power generation mode is selected; and safety engine control means for conducting a control to limit the rotational speed of said engine to a rotational speed which is equal to or less than a speed limit in the power generation mode when said throttle position determination means determines that said throttle valve is placed closer to the acceleration side than the normal position in the power generation mode, and said safety engine control means is comprised so as to stop at least either supply of fuel to said engine or an ignition operation of said engine to limit the rotational speed of said engine to said speed limit or less when the rotational speed of said engine exceeds said speed limit.

8. The control device for an engine driven vehicle according to claim 7, wherein said power transmission device comprises a centrifugal clutch that is closed when the engine rotates at a rotational speed which is equal to or more than a clutch-in speed, and said speed limit is set to a rotational speed which is equal to or less than a rotational speed of the engine when an output voltage of said generator reaches an allowable upper limit value, and which is less than said clutch-in speed.

9. The control device for an engine driven vehicle according to claim 8, further comprising a position sensor that detects the position of said throttle valve, wherein said throttle position determination means is comprised so as to determine whether said throttle valve is placed closer to the acceleration side than the normal position in the power generation mode from an output of said position sensor.

10. The control device for an engine driven vehicle according to claim 8, further comprising a position detection switch that is in different states between when said throttle valve is in the normal position in the power generation mode and when the throttle valve is placed closer to the acceleration side than the normal position in the power generation mode, wherein said throttle position determination means is comprised so as to determine whether said throttle valve is placed closer to the acceleration side than the normal position in the power generation mode from a state of said position detection switch.

11. The control device for an engine driven vehicle according to claim 7, further comprising a position sensor that detects the position of said throttle valve, wherein said throttle position determination means is comprised so as to determine whether said throttle valve is placed closer to the acceleration side than the normal position in the power generation mode from an output of said position sensor.

12. The control device for an engine driven vehicle according to claim 7, further comprising a position detection switch that is in different states between when said throttle valve is in the normal position in the power generation mode and when the throttle valve is placed closer to the acceleration side than the normal position in the power generation mode, wherein said throttle position determination means is comprised so as to determine whether said throttle valve is placed closer to the acceleration side than the normal position in the power generation mode from a state of said position detection switch.

13. A control device for an engine driven vehicle comprising:

a vehicle body having drive wheels;

an engine incorporated in said vehicle body;

a power transmission device provided between a crankshaft of said engine and said drive wheels; and a generator provided to be driven by said engine without via said power transmission device, wherein said control device further comprises:

power generation time intake air amount control means for controlling an intake air amount adjustment valve that adjusts the amount of air flowing through an air passage that bypasses a throttle valve of said engine so as to rotate said engine at a rotational speed suitable for supplying power from said generator to an external load when a power generation mode is selected while said engine driven vehicle is stopped;

throttle position determination means for determining whether said throttle valve is placed closer to an acceleration side than a normal position in the power generation mode when said power generation mode is selected; and safety engine control means for conducting a control to stop said engine when said throttle position determination means determines that said throttle valve is placed closer to the acceleration side than the normal position in the power generation mode, and said safety engine control means is comprised so as to stop at least either supply of fuel to said engine or an ignition operation of said engine to stop said engine.

14. The control device for an engine driven vehicle according to claim 13, further comprising a position sensor that detects the position of said throttle valve, wherein said throttle position determination means is comprised so as to determine whether said throttle valve is placed closer to the acceleration side than the normal position in the power generation mode from an output of said position sensor.

15. The control device for an engine driven vehicle according to claim 13, further comprising a position detection switch that is in different states between when said throttle valve is in the normal position in the power generation mode and when the throttle valve is placed closer to the acceleration side than the normal position in the power generation mode, wherein said throttle position determination means is comprised so as to determine whether said throttle valve is placed closer to the acceleration side than the normal position in the power generation mode from a state of said position detection switch.

16. A control device for an engine driven vehicle comprising:

a vehicle body having drive wheels;

an engine incorporated in said vehicle body;

a power transmission device provided between a crankshaft of said engine and said drive wheels; and a generator provided to be driven by said engine without via said power transmission device, wherein said control device further comprises:

power generation time intake air amount control means for controlling a fully closed position of a throttle valve of said engine so as to rotate said engine at a rotational speed suitable for supplying power from said generator to an external load when a power generation mode is selected while said engine driven vehicle is stopped;

throttle position determination means for determining whether said throttle valve is placed closer to an acceleration side than a normal position in the power generation mode when said power generation mode is selected; and safety engine control means for conducting a control to stop said engine when said throttle position determination means determines that said throttle valve is placed closer to the acceleration side than the normal position in the power generation mode, and said safety engine control means is comprised so as to stop at least either supply of fuel to said engine or an ignition operation of said engine to control said engine.

17. The control device for an engine driven vehicle according to claim 16, further comprising a position sensor that detects the position of said throttle valve, wherein said throttle position determination means is comprised so as to determine whether said throttle valve is placed closer to the acceleration side than the normal position in the power generation mode from an output of said position sensor.

18. The control device for an engine driven vehicle according to claim 16, further comprising a position detection switch that is in different states between when said throttle valve is in the normal position in the power generation mode and when the throttle valve is placed closer to the acceleration side than the normal position in the power generation mode, wherein said throttle position determination means is comprised so as to determine whether said throttle valve is placed closer to the acceleration side than the normal position in the power generation mode from a state of said position detection switch.

* * * * *